US006193469B1

(12) United States Patent
Tsuda et al.

(10) Patent No.: US 6,193,469 B1
(45) Date of Patent: Feb. 27, 2001

(54) HIGH TOUGHNESS HEAT-RESISTANT STEEL, TURBINE ROTOR AND METHOD OF PRODUCING THE SAME

(75) Inventors: Yoichi Tsuda; Ryuichi Ishii, both of Toyko; Masayuki Yamada, Yokohama, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/046,793

(22) Filed: Mar. 24, 1998

(30) Foreign Application Priority Data

Mar. 25, 1997 (JP) ..... 9-72258

(51) Int. Cl.[7] ..... F01D 5/28

(52) U.S. Cl. ..... 416/241 R; 415/200; 415/216.1; 420/38; 420/69; 148/609; 148/610

(58) Field of Search ..... 416/241 R; 415/99, 415/100, 101, 102, 103, 200, 216.1; 420/38, 69; 148/609, 610, 325; 29/889, 889.7

(56) References Cited

FOREIGN PATENT DOCUMENTS

| | | |
|---|---|---|
| 0 333 129 | 9/1989 | (EP) . |
| 0 384 181 | 8/1990 | (EP) . |
| 0 639 691 | 2/1995 | (EP) . |
| 62-83451 | 4/1987 | (JP) . |
| 2-101143 | 4/1990 | (JP) . |
| 4-147948 | 5/1992 | (JP) . |

OTHER PUBLICATIONS

Patent Abstracts of Japan, vol. 005, No. 195 (C–083), Dec. 11, 1981, JP 56 116858, Sep. 12, 1981, Oct. 3, 2000.

*Primary Examiner*—Edward K. Look
*Assistant Examiner*—Liam McDowell
(74) *Attorney, Agent, or Firm*—Oblon, Spivak, McClelland, Maier & Neustadt, P.C.

(57) ABSTRACT

A high toughness heat-resistant steel, a turbine rotor formed of this steel and a method of producing the turbine rotor are described. The heat-resistant steel has a composition consisting essentially of: 0.05 to 0.30 wt % C, 0 to 0.20 wt % Si, 0 to 1.0 wt % Mn, 8.0 to 14.0 wt % Cr, 0.5 to 3.0 wt % Mo, 0.10 to 0.50 wt % V, 2.0 to 5.0 wt % Ni, 0.01 to 0.50 wt % Nb, 0.01 to 0.08 wt % N, 0.001 to 0.020 wt % B, balance Fe and unavoidable impurities. The steel has excellent characteristics in not only tensile strength and toughness at a relatively low temperature condition of a steam turbine such as high/low pressure combined type one but also creep rupture strength at a high temperature condition of this turbine.

20 Claims, No Drawings

HIGH TOUGHNESS HEAT-RESISTANT STEEL, TURBINE ROTOR AND METHOD OF PRODUCING THE SAME

BACKGROUND OF THE INVENTION

The present invention relates to a high toughness heat-resistant steel, a turbine rotor and a method of producing the same, and more particularly, to improvements in material of the high toughness heat-resistant steel used for high/low pressure combined type turbine rotor and the like which are especially suitable for a power plant aiming at a large volume and high efficiency.

In general, in a steam turbine in which a plurality of turbine rotors are mechanically coupled together, materials for the rotors are selected in accordance with steam conditions used from the high pressure side to the low pressure side. For example, CrMoV steel (ASTM-A470 (class 8)) or 12Cr steel (Japanese Patent Application Publication No.60-54385) is used as a material for turbine rotor used at the side of high temperature (550 to 600° C.) and high pressure, and NiCrMoV steel (ASTM-A471 (classes 2 to 7)) including 2.5% or more of Ni is used as a material for turbine rotor used at the side of low temperature (400° C. or lower) and high pressure.

In a recent power plant achieving large volume and high efficiency, a so-called high/low pressure combined type turbine rotor in which a high pressure side portion and a low pressure side portion are integrally formed of the same material has attracted attention, in view of miniaturization of the steam turbine and simplification of the structure.

However, since the conventional steel for the above-described turbine rotor is not a material intended to be used under the condition which covers all of the requirements from the high pressure side to the low pressure side, if such a conventional steel is used to form the high/low pressure combined type turbine rotor, the following problems are present:

1): In the case of CrMoV steel, although it is excellent in creep rupture strength in a high temperature region of about 550° C., its tensile strength and toughness are not always satisfactory in a low temperature region, and ductile fracture, brittle fracture or the like are likely to occur. Thus, to counteract this, it is necessary to reduce stress acting on the lower pressure portion of the turbine rotor. As a result, the size of a blade mounted at a low pressure stage, especially at the final stage is restricted. From this point of view, it is difficult to increase the volume of a power plant. Further, also with respect to high temperature creep rupture strength, CrMoV steel does not always satisfy the condition of high temperature (about 600° C.) and high pressure of steam at the entrance of a turbine that is required for enhancing the efficiency of a power plant.

2) In the case of 12Cr steel, this steel is superior to CrMoV steel in high temperature creep rupture strength, and thus can satisfy the above-described condition for the steam at the entrance of the turbine. However, since this steel does not have enough toughness, a countermeasure also is required as in the case of CrMoV steel, and the size of blade that can be mounted at the low pressure stage is limited.

3) In the case of NiCrMoV steel, although this steel has excellent tensile strength and toughness at the low temperature region, its creep rupture strength is not always satisfactory, and since the strength of this steel used at the high pressure side is not sufficient, it is necessary to limit the degree of high temperature of the steam at entrance of turbine, and it is difficult to enhance the efficiency of the power plant.

As described above, when a high/low pressure combined type turbine rotor is formed using the conventional steel, there is a problem that a great restriction can not be avoided when an effort is made for increasing volume and enhancing the efficiency in a steam turbine in which a long low pressure final stage blade is mounted.

SUMMARY OF THE INVENTION

The present invention has been accomplished in view of the conventional problems, and it is an object of the invention to provide a heat-resistant steel having excellent characteristics in both tensile strength and toughness at a relatively low temperature region and creep rupture strength at a high temperature region.

Further, it is another object of the invention to provide a turbine rotor such as high/low pressure combined type turbine rotor suitable for a power plant requiring a large volume and high efficiency.

To achieve the above objects, a high toughness heat-resistant steel according to the present invention has a composition comprising: 0.05 to 0.30 wt % C, 0.20 wt % or less Si, 1.0 wt % or less Mn, 8.0 to 14.0 wt % Cr, 0.5 to 3.0 wt % Mo, 0.10 to 0.50 wt % V, 1.5 to 5.0 wt % Ni, 0.01 to 0.50 wt % Nb, 0.01 to 0.08 wt % N, 0.001 to 0.020 wt % B, the balance being Fe and unavoidable impurities. Preferably, the high toughness heat-resistant steel further includes 0.5 to 6.0 wt % Co.

A high toughness heat-resistant steel according to another example of the present invention has a composition comprising: 0.05 to 0.30 wt % C, 0 to 0.20 wt % Si, 0 to 1.0 wt % Mn, 8.0 to 14.0 wt % Cr, 0.1 to 2.0 wt % Mo, 0.3 to 5.0 wt % W, 0.10 to 0.50 wt % V, 1.5 to 5.0 wt % Ni, 0.01 to 0.50 wt % Nb, 0.01 to 0.08 wt % N, 0.001 to 0.020 wt % B, the balance being Fe and unavoidable impurities. Preferably, the high toughness heat-resistant steel further includes 0.5 to 6.0 wt % Co.

The reason for limiting the ranges of contents of compositions of each of the elements in the high toughness heat-resistant steel of the present invention will be described below. Here, it should be noted that % showing composition (content) of each the elements means % by weight, unless there is a description to the contrary.

C is bonded to elements such as Cr, Nb and V to form carbohydrate and contributes to strengthening precipitation, and is an indispensable element for enhancing the hardening properties or for suppressing the generation of δ ferrite. Here, if an amount of C added is less than 0.05%, a desired creep rupture strength can not be obtained, and if the amount of C added exceeds 0.30%, this facilitates coarsening carbohydrate, and the creep rupture strength over long time period is lowered. Therefore, C content is set in a range of 0.05% to 0.30%, preferably, in a range of 0.07% to 0.25%, and more preferably, in a range of 0.09% to 0.20%.

Si is a necessary element as a deoxidizer at the time of melting. However, if a large amount of Si is added, a portion thereof remains in the steel as an oxide to lower the toughness. Therefore, Si content is set in a range of 0.20% or less.

Mn is a necessary element as a deoxidizer or desulfurizing agent at the time of melting. However, if a large amount of Mn is added, the creep rupture strength of the steel is lowered and therefore, Mn content is set in a range of 1.0% or less.

Cr is a necessary element as a component element of M23C6-type precipitation which enhances antioxidation properties and anticurrosiveness, and contributes to strengthen the solid solution and precipitation. However, if an amount of Cr added is less than 8.0%, its effect is small, and if the amount of Cr added exceeds 14.0%, δ ferrite which is harmful for toughness and creep rupture strength is prone to be generated. Therefore, Cr content is set in a range of 8.0% to 14.0%, preferably, in a range of 9.0% to 13.0%, and more preferably, in a range of 9.5% to 12.5%.

Mo is a necessary element as a component element as a solid solution strengthen element and carbohydrate. However, if an amount of Mo added is less than 0.5%, such effects are small, and if the amount of Mo added exceeds 3.0%, toughness is significantly lowered, and δ ferrite is prone to be generated. Therefore, Mo content is set in a range of 0.5% to 3.0%, preferably, in a range of 0.7% to 2.5%, and more preferably, in a range of 0.9% to 2.0%.

Here, if W (which will be described later) which exhibits substantially the same function as that of Mo is to be added, if an amount of Mo added is less than 0.1%, its effects as a solid solution strengthening element and a carbohydrate element are small, and if the amount of W added exceeds 2.0%, toughness is significantly lowered, and δ ferrite is prone to be generated. Therefore, W content is set in a range of 0.1% to 2.0%, preferably, in a range of 0.2% to 1.5%, and more preferably, in a range of 0.5% to 1.2%.

V is an element contributing to strengthen the solid solution and to form V-carbohydrate. If an amount of V is equal to or greater than 0.10%, the fine precipitation takes place in the creep mainly on the martensite lath boundary to suppress the recovery. However, if the amount of V exceeds 0.50%, δ ferrite is prone to be generated. Further, if the amount of V is less than 0.10%, the solid solution amount and the precipitation amount are small and the above-mentioned effects can not be obtained. Therefore, V content is set in a range of 0.10% to 0.50%, preferably, in a range of 0.10% to 0.40%, and more preferably, in a range of 0.15% to 0.30%.

Ni is an element which largely enhances the hardening properties and toughness, and suppresses the precipitation of δ ferrite. However, if an amount of Ni added is less than 1.5%, such effects are small, and if the amount of Ni added exceeds 5.0%, creep resistance is lowered. Therefore, Ni content is set in a range of 1.5% to 5.0%, preferably, in a range of 1.5% to 4.0%, and more preferably, in a range of 2.0% to 3.0%.

Nb is an element which forms fine carbon-nitride of Nb(C, N) by bonding to C and N, and contributes to strengthen the precipitation dispersion. However, if an amount of Nb added is less than 0.01%, precipitation density is low and the above-mentioned effects can not be obtained, and if the amount of Nb added exceeds 0.50%, a coarse Nb (C, N) which has not yet been solidified is prone to be formed, and ductile and toughness are lowered. Therefore, Nb content is set in a range of 0.01% to 0.50%, preferably, in a range of 0.01% to 0.30%, and more preferably, in a range of 0.03% to 0.20%.

N is an element which forms nitride or carbon-nitride and contributes to strengthen the precipitation dispersion, and which remains in base phase to also contribute to strengthen the solid solution. However, if an amount of N added is less than 0.01%, such effects can not be obtained, and if the amount of N added exceeds 0.08%, this facilitates to coarsen nitride or carbon-nitride and creep resistance is lowered, and ductile and toughness are also lowered. Therefore, N content is set in a range of 0.01% to 0.08%, preferably, in a range of 0.01% to 0.06%, and more preferably, in a range of 0.02% to 0.04%.

B is an element which facilitates precipitation on crystal grain boundary. With a small amount of B added, it enhances stability of carbon-nitride at high temperature for a long time. However, if an amount of B added is less than 0.001%, such effects can not be obtained, and if the amount of B added exceeds 0.020%, toughness is significantly lowered and hot-working properties are deteriorated. Therefore, B content is set in a range of 0.001% to 0.020%, preferably, in a range of 0.003% to 0.015%, and more preferably, in a range of 0.005% to 0.012%.

W is an element which contributes as solid solution reinforcing element and as a carbide, and also contributes to formation of intermetallic compounds comprising Fe, Cr, and W and the like. Therefore, W is added when excellent creep rupture strength is required. However, if the amount of W added is less than 0.3%, little of such effect can be obtained, and if the amount of W added exceeds 5.0%, δ ferrite is prone to be formed, and toughness and heat fragile characteristics are significantly lowered. Therefore, W content is set in a range of 0.3% to 5.0%, preferably, in a range of 0.5% to 3.0%, and more preferably, in a range of 1.0% to 2.5%.

Co is an element which contributes to strengthen the solid solution and suppresses δ ferrite from being formed and therefore, Co is added if necessary. However, if an amount of Co added is less than 0.5%, such effects can not be obtained, and if the amount of Co added exceeds 6.0% working properties are deteriorated. Therefore, Co content is set in a range of 0.5% to 6.0%.

When each of the above-described elements and Fe are added, it is desirable to reduce, to the utmost, the amount of impurities which may be invariably industrial.

A turbine rotor according to the present invention is characterized in that it is formed of high toughness heat-resistant steel.

A method of producing a turbine rotor according to the present invention comprises the steps of: preparing a material of the chemical compositions according to the present invention; forming a turbine rotor blank using the material; subjecting the turbine rotor blank to a hardening by heating at a temperature of 950° C. to 1,120° C., and then; tempering the turbine rotor blank, at least once, at a temperature of 550° C. to 740° C.

Preferably, the heating temperature in the hardening step is set in a range of 1,030° C. (inclusive) to 1,120° C. (inclusive) for a high pressure portion or an intermediate pressure portion of the turbine rotor blank, and is set in a range of 950° C. (inclusive) to 1,030° C. (inclusive) for a low pressure portion of the turbine rotor blank.

Preferably, the temperature in the tempering step is set in a range of 550° C. (inclusive) to 630° C. (inclusive) for a high pressure portion or an intermediate pressure portion of the turbine rotor blank, and is set in a range of 630° C. (inclusive) to 740° C. (inclusive) for a low pressure portion of the turbine rotor blank.

Reasons for defining the thermal treatment conditions of the present invention will be described below.

Hardening treatment is a necessary thermal treatment for providing a turbine rotor blank with excellent strength. However, if the heating temperature is less than 950° C., austenitization is not sufficient and hardening can not be performed, and if the heating temperature exceeds 1,120° C., austenitic crystal grain is excessively coarsened, and ductility is lowered. Therefore, the heating temperature is set in a range of 950° C. to 1,120° C.

Here, since creep rupture strength is especially important for the portion of the rotor blank corresponding to its high pressure or intermediate pressure portion, it is desirable that each of the precipitations is sufficiently formed into a solid solution by hardening at a high heating temperature in a range of 1,030° C. to 1,120° C. and then, it is again finely precipitated by tempering. Further, since a tensile strength and toughness are especially important for a portion of the rotor blank corresponding to its low pressure portion, it is desirably to finely pulverize the crystal grains by hardening at a low temperature in a range of 950° C. to 1,030° C.

Tempering treatment is a thermal treatment which is necessary to be carried out once or more so as to provide the turbine rotor blank with a desired strength. However, if the heating temperature of the tempering is less than 550° C., a sufficient tempering effect can not be obtained and thus excellent toughness can not be obtained, and if the temperature exceeds 740° C., a desired strength can not be obtained. Therefore, the heating temperature is set in a range of 550° C. to 740° C.

Here, since creep rupture strength is especially important for the portions of the rotor blank corresponding to its high pressure portion and intermediate pressure portion, it is desirable that a tempering treatment at a high heating temperature in a range of 630° C. to 740° C. is carried out at least once, and precipitation which has been formed into solid solution by hardening is again sufficiently precipitated. Further, since tensile strength and toughness are especially important for a portion of the rotor blank corresponding to its low pressure portion, it is desirably to carry out the tempering treatment at least once at a low heating temperature in a range of 550° C. to 630° C., thereby satisfying both a desired tensile strength and excellent toughness.

As a process for forming the turbine rotor blank, it is preferable to use a process in which a steel ingot for the turbine rotor blank is produced using electroslag remelting.

In a large-sized blank, typified by a steam turbine rotor, when a steel ingot is solidified, segregation of added element or ununiformity in a solidified composite are prone to be generated. Especially, when various elements are added in order to enhance material characteristics, the tendency of segregation is increased at a center portion of the steel ingot, and the ductile or toughness at the center portion of the rotor blank tends to be lowered. Therefore, if electroslag remelting is used as a method for producing the steel ingot for forming the turbine rotor blank, a more homogeneous and cleaner steel ingot can be obtained. As other measures, a vacuum carbon deoxidization and the like may be used.

According to the present invention, as described above, it is possible to provide a high toughness heat-resistant steel having high creep rupture strength even under high temperature steam condition, and having high tensile strength and toughness even under relatively low temperature steam condition. Therefore, if a turbine rotor, especially a high/low pressure combined type turbine rotor is formed using this high toughness heat-resistant steel, there is the advantage that the turbine rotor can be used in a high temperature steam environment and in a low pressure final long stage. It is thus possible to construct a power plant having a large volume and high efficiency using a high/low pressure combined type turbine rotor which was not realized before.

DESCRIPTION OF THE PREFERRED EMBODIMENTS

Preferred embodiments for carrying out the invention for a high toughness heat-resistant steel, a turbine rotor and a method for producing the same will be described below.

First Embodiment

EXAMPLES 1 TO 14

Examples 1 to 44 of a sample Table 1 shows the composition of Examples 1–44 sample materials M1 to M30 do not include W and Mo, the materials M31 to M40 include W, and the materials M41 to M44 include W and Mo.

TABLE 1

| | | Chemical Composition (wt %) | | | | | | | | | | | | |
|---|---|---|---|---|---|---|---|---|---|---|---|---|---|---|
| | Sample No. | C | Si | Mn | Cr | Mo | V | Ni | Nb | N | B | W | Co | Fe |
| Example 1 | M 1 | 0.12 | 0.05 | 0.07 | 11.65 | 1.61 | 0.21 | 2.63 | 0.06 | 0.022 | 0.006 | — | — | Bal. |
| Example 2 | M 2 | 0.15 | 0.08 | 0.18 | 10.92 | 1.39 | 0.20 | 2.46 | 0.10 | 0.025 | 0.007 | — | — | Bal. |
| Example 3 | M 3 | 0.08 | 0.15 | 0.10 | 10.23 | 1.76 | 0.19 | 2.72 | 0.07 | 0.027 | 0.008 | — | — | Bal. |
| Example 4 | M 4 | 0.21 | 0.06 | 0.08 | 11.95 | 1.80 | 0.25 | 2.35 | 0.09 | 0.025 | 0.005 | — | — | Bal. |
| Example 5 | M 5 | 0.06 | 0.10 | 0.20 | 10.88 | 1.53 | 0.17 | 2.52 | 0.05 | 0.022 | 0.007 | — | — | Bal. |
| Example 6 | M 6 | 0.27 | 0.12 | 0.15 | 11.02 | 1.65 | 0.21 | 2.81 | 0.08 | 0.030 | 0.008 | — | — | Bal. |
| Example 7 | M 7 | 0.14 | 0.08 | 0.22 | 9.90 | 1.78 | 0.22 | 2.27 | 0.08 | 0.022 | 0.008 | — | — | Bal. |
| Example 8 | M 8 | 0.16 | 0.09 | 0.11 | 12.40 | 1.72 | 0.25 | 2.50 | 0.07 | 0.023 | 0.006 | — | — | Bal. |
| Example 9 | M 9 | 0.12 | 0.11 | 0.09 | 8.80 | 1.66 | 0.19 | 2.48 | 0.07 | 0.029 | 0.009 | — | — | Bal. |
| Example 10 | M 10 | 0.12 | 0.09 | 0.13 | 13.20 | 1.27 | 0.20 | 2.87 | 0.12 | 0.031 | 0.005 | — | — | Bal. |
| Example 11 | M 11 | 0.15 | 0.09 | 0.14 | 11.87 | 0.80 | 0.26 | 2.60 | 0.08 | 0.025 | 0.010 | — | — | Bal. |
| Example 12 | M 12 | 0.13 | 0.15 | 0.30 | 10.59 | 2.30 | 0.22 | 2.38 | 0.07 | 0.022 | 0.006 | — | — | Bal. |
| Example 13 | M 13 | 0.13 | 0.11 | 0.09 | 10.98 | 0.60 | 0.20 | 2.57 | 0.09 | 0.032 | 0.006 | — | — | Bal. |
| Example 14 | M 14 | 0.18 | 0.10 | 0.15 | 11.45 | 2.70 | 0.17 | 2.59 | 0.08 | 0.028 | 0.009 | — | — | Bal. |
| Example 15 | M 15 | 0.13 | 0.14 | 0.18 | 11.54 | 1.59 | 0.13 | 2.47 | 0.10 | 0.024 | 0.008 | — | — | Bal. |
| Example 16 | M 16 | 0.14 | 0.12 | 0.13 | 11.84 | 1.65 | 0.33 | 2.70 | 0.09 | 0.025 | 0.008 | — | — | Bal. |
| Example 17 | M 17 | 0.15 | 0.09 | 0.09 | 11.75 | 1.69 | 0.45 | 2.58 | 0.07 | 0.027 | 0.009 | — | — | Bal. |
| Example 18 | M 18 | 0.14 | 0.11 | 0.26 | 10.08 | 1.48 | 0.18 | 1.80 | 0.05 | 0.021 | 0.006 | — | — | Bal. |
| Example 19 | M 19 | 0.17 | 0.16 | 0.11 | 11.83 | 1.79 | 0.22 | 3.50 | 0.08 | 0.024 | 0.007 | — | — | Bal. |
| Example 20 | M 20 | 0.15 | 0.08 | 0.08 | 11.69 | 1.68 | 0.20 | 4.40 | 0.06 | 0.030 | 0.011 | — | — | Bal. |
| Example 21 | M 21 | 0.13 | 0.12 | 0.27 | 10.36 | 1.64 | 0.21 | 2.80 | 0.02 | 0.025 | 0.006 | — | — | Bal. |
| Example 22 | M 22 | 0.14 | 0.09 | 0.12 | 10.74 | 1.72 | 0.22 | 2.49 | 0.23 | 0.026 | 0.007 | — | — | Bal. |
| Example 23 | M 23 | 0.14 | 0.11 | 0.15 | 11.38 | 1.56 | 0.27 | 2.66 | 0.36 | 0.030 | 0.006 | — | — | Bal. |
| Example 24 | M 24 | 0.16 | 0.09 | 0.09 | 11.77 | 1.80 | 0.26 | 2.53 | 0.10 | 0.016 | 0.008 | — | — | Bal. |
| Example 25 | M 25 | 0.12 | 0.14 | 0.18 | 11.84 | 1.90 | 0.24 | 2.43 | 0.09 | 0.045 | 0.007 | — | — | Bal. |
| Example 26 | M 26 | 0.11 | 0.10 | 0.15 | 11.61 | 1.75 | 0.21 | 2.70 | 0.07 | 0.070 | 0.008 | — | — | Bal. |
| Example 27 | M 27 | 0.15 | 0.08 | 0.10 | 10.69 | 1.43 | 0.24 | 2.55 | 0.07 | 0.030 | 0.004 | — | — | Bal. |
| Example 28 | M 28 | 0.12 | 0.13 | 0.12 | 11.51 | 1.70 | 0.23 | 2.68 | 0.08 | 0.027 | 0.014 | — | — | Bal. |
| Example 29 | M 29 | 0.14 | 0.13 | 0.21 | 11.74 | 1.80 | 1.21 | 2.22 | 0.08 | 0.024 | 0.002 | — | — | Bal. |
| Example 30 | M 30 | 0.14 | 0.09 | 0.16 | 11.05 | 1.48 | 0.19 | 2.88 | 0.06 | 0.028 | 0.019 | — | — | Bal. |

TABLE 1-continued

| | Sample No. | Chemical Composition (wt %) | | | | | | | | | | | | |
|---|---|---|---|---|---|---|---|---|---|---|---|---|---|---|
| | | C | Si | Mn | Cr | Mo | V | Ni | Nb | N | B | W | Co | Fe |
| Example 31 | M 31 | 0.13 | 0.05 | 0.09 | 11.63 | 0.68 | 0.21 | 2.58 | 0.06 | 0.021 | 0.006 | 1.81 | — | Bal. |
| Example 32 | M 32 | 0.14 | 0.08 | 0.17 | 10.88 | 1.06 | 0.20 | 2.43 | 0.09 | 0.026 | 0.008 | 1.17 | — | Bal. |
| Example 33 | M 33 | 0.10 | 0.10 | 0.26 | 11.17 | 1.11 | 0.26 | 2.63 | 0.07 | 0.029 | 0.008 | 0.70 | — | Bal. |
| Example 34 | M 34 | 0.14 | 0.10 | 0.13 | 11.67 | 0.56 | 0.18 | 2.51 | 0.07 | 0.022 | 0.007 | 2.84 | — | Bal. |
| Example 35 | M 35 | 0.15 | 0.09 | 0.09 | 11.73 | 1.10 | 0.19 | 2.56 | 0.10 | 0.030 | 0.009 | 0.42 | — | Bal. |
| Example 36 | M 36 | 0.14 | 0.08 | 0.14 | 11.45 | 0.70 | 0.22 | 2.49 | 0.09 | 0.025 | 0.007 | 3.99 | — | Bal. |
| Example 37 | M 37 | 0.12 | 0.13 | 0.22 | 10.15 | 0.30 | 0.26 | 2.31 | 0.08 | 0.025 | 0.007 | 2.04 | — | Bal. |
| Example 38 | M 38 | 0.13 | 0.08 | 0.23 | 10.78 | 1.40 | 0.21 | 2.60 | 0.08 | 0.023 | 0.010 | 1.36 | — | Bal. |
| Example 39 | M 39 | 0.16 | 0.12 | 0.13 | 11.43 | 0.10 | 0.22 | 2.71 | 0.05 | 0.022 | 0.007 | 2.31 | — | Bal. |
| Example 40 | M 40 | 0.14 | 0.09 | 0.15 | 11.70 | 1.80 | 0.21 | 2.66 | 0.06 | 0.028 | 0.006 | 1.25 | — | Bal. |
| Example 41 | M 41 | 0.14 | 0.10 | 0.09 | 11.56 | 0.73 | 0.20 | 2.53 | 0.05 | 0.025 | 0.007 | 1.87 | 3.03 | Bal. |
| Example 42 | M 42 | 0.15 | 0.12 | 0.10 | 11.38 | 0.58 | 0.25 | 2.79 | 0.07 | 0.028 | 0.009 | 1.75 | 2.10 | Bal. |
| Example 43 | M 43 | 0.12 | 0.11 | 0.14 | 10.62 | 0.98 | 0.24 | 2.37 | 0.07 | 0.031 | 0.008 | 1.38 | 0.90 | Bal. |
| Example 44 | M 44 | 0.12 | 0.07 | 0.18 | 11.07 | 0.83 | 0.24 | 2.49 | 0.06 | 0.024 | 0.007 | 1.65 | 4.20 | Bal. |

50 kg of each of the sample materials of examples 1 to 44 was melted using a vacuum high frequency induction electric furnace, and after casting, it was heated to 1,200° C., press-forged and stretched to prepare a round rod having a diameter of 60 mm. Thereafter, the round rod was subjected to the thermal treatment condition HM1 shown in Table 2, i.e., a hardening at 1,030° C. and then, a tempering once at 630° C. once.

TABLE 2

| Thermal Treatment No. | Thermal Treatment Condition: Harding | Tempering: First Time | Tempering: Second Time |
|---|---|---|---|
| HM 1 | 1030° C. × 5 h → Oil-cooling | 630° C. × 20 h → Air-cooling | — |
| HM 2 | 1030° C. × 5 h → Oil-cooling | 630° C. × 20 h → Air-cooling | 475° C. × 5 h → Air-cooling |
| HM 3 | 1000° C. × 5 h → Oil-cooling | 630° C. × 20 h → Air-cooling | — |
| HM 4 | 1070° C. × 5 h → Oil-cooling | 630° C. × 20 h → Air-cooling | — |
| HM 5 | 1030° C. × 5 h → Oil-cooling | 600° C. × 20 h → Air-cooling | — |
| HM 6 | 1030° C. × 5 h → Oil-cooling | 660° C. × 20 h → Air-cooling | — |
| HM 7 | 1000° C. × 5 h → Oil-cooling | 600° C. × 20 h → Air-cooling | — |
| HM 8 | 1070° C. × 5 h → Oil-cooling | 660° C. × 20 h → Air-cooling | — |
| HM 9 | 1000° C. × 5 h → Oil-cooling | 600° C. × 20 h → Air-cooling | 475° C. × 5 h → Air-cooling |
| HM 10 | 1070° C. × 5 h → Oil-cooling | 660° C. × 20 h → Air-cooling | 475° C. × 5 h → Air-cooling |
| HS 1 | 970° C. × 5 h → Air-cooling | 680° C. × 20 h → Air-cooling | — |
| HS 2 | 830° C. × 5 h → Air-cooling | 610° C. × 20 h → Air-cooling | — |
| HS 3 | 1050° C. × 5 h → Oil-cooling | 570° C. × 5 h → Air-cooling | 660° C. × 20 h → Air-cooling |
| HS 4 | 930° C. × 5 h → Oil-cooling | 630° C. × 20 h → Air-cooling | — |
| HS 5 | 1140° C. × 5 h → Oil-cooling | 630° C. × 20 h → Air-cooling | — |
| HS 6 | 1030° C. × 5 h → Oil-cooling | 530° C. × 20 h → Air-cooling | — |
| HS 7 | 1030° C. × 5 h → Oil-cooling | 760° C. × 20 h → Air-cooling | — |

A test piece was cut out from each of the round rod sample materials obtained in this manner, tensile test, Charpy impact test and creep fracture test were carried out. The tensile test is for finding out tensile strength, yield strength, elongation, reduction of area and the like for evaluating that the tensile strength is excellent since the tensile strength and the yield strength are greater, and the ductility is excellent since the elongation and the reduction of area are greater.

The Charpy impact test is for finding out impact value, FATT and the like of the sample materials for evaluating that the toughness is excellent since the impact value is greater or the FATT value is smaller. Generally, the impact value is a temperature variable value showing unfrangibility, i.e., toughness when an impact force is applied to the sample material at room temperature (20° C.). FATT means a ductile-brittle transition temperature obtained by fracture ratio of the impact test piece, i.e., a temperature at which an area ratio of the ductile fracture measured at high temperature region having greater impact value and a brittle fracture measured at low temperature region having smaller impact value becomes 50%-50% in an intermediate temperature region in which both the ductile fracture and the brittle fracture mixedly exist.

The creep rupture test is for finding out the creep rupture strength and the like of the sample material. The creep rupture strength is a characteristic corresponding to creep rupture time, and such strength increases as the rupture time is longer. Here, if results of creep rupture tests (test temperature, test stress and fracture time) obtained from a plurality of test pieces are sorted out using the Larson-Miller parameter, it is possible to find out a creep rupture strength (such as 105 hours rupture strength) at an arbitrary temperature (such as 580° C.).

Table 3 shows measurement results of the above described material tests for tensile strength, 0.02% yield strength, elongation, reduction of area, FATT and 100,000 ($=10^5$) hours rupture strength.

TABLE 3

| | Sample No. | Thermal Treatment No. | Tensile Test: Tensile Strength (Mpa) | Tensile Test: 0.02% Yield Strength (Mpa) | Tensile Test: Elongation (%) | Tensile Test: Reduction of Area (%) | Impact Test FATT (° C.) | Creep Rupture Test 580° C., 105 Hours Rupture Streng (Mpa) |
|---|---|---|---|---|---|---|---|---|
| Example 1 | M 1 | HM 1 | 1022 | 758 | 22 | 64 | −32 | 127 |
| Example 2 | M 2 | HM 1 | 1030 | 760 | 23 | 64 | −37 | 132 |
| Example 3 | M 3 | HM 1 | 1006 | 726 | 23 | 65 | −23 | 120 |
| Example 4 | M 4 | HM 1 | 1035 | 762 | 23 | 63 | −35 | 103 |
| Example 5 | M 5 | HM 1 | 993 | 721 | 24 | 64 | −25 | 115 |
| Example 6 | M 6 | HM 1 | 971 | 714 | 25 | 66 | −29 | 97 |
| Example 7 | M 7 | HM 1 | 1018 | 755 | 21 | 62 | −34 | 126 |
| Example 8 | M 8 | HM 1 | 1027 | 757 | 21 | 60 | −30 | 124 |
| Example 9 | M 9 | HM 1 | 1020 | 748 | 22 | 63 | −35 | 121 |
| Example 10 | M 10 | HM 1 | 1032 | 760 | 21 | 63 | −27 | 116 |
| Example 11 | M 11 | HM 1 | 1016 | 744 | 22 | 61 | −33 | 120 |
| Example 12 | M 12 | HM 1 | 1028 | 757 | 21 | 61 | −29 | 132 |
| Example 13 | M 13 | HM 1 | 1019 | 744 | 23 | 64 | −37 | 109 |
| Example 14 | M 14 | HM 1 | 1027 | 759 | 20 | 60 | −24 | 133 |
| Example 15 | M 15 | HM 1 | 1009 | 728 | 22 | 63 | −38 | 119 |
| Example 16 | M 16 | HM 1 | 1027 | 750 | 21 | 61 | −30 | 127 |
| Example 17 | M 17 | HM 1 | 1030 | 748 | 20 | 63 | −25 | 125 |
| Example 18 | M 18 | HM 1 | 997 | 730 | 23 | 65 | −24 | 130 |
| Example 19 | M 19 | HM 1 | 1024 | 749 | 21 | 63 | −36 | 121 |
| Example 20 | M 20 | HM 1 | 1023 | 754 | 22 | 60 | −39 | 112 |
| Example 21 | M 21 | HM 1 | 1020 | 757 | 22 | 62 | −35 | 106 |
| Example 22 | M 22 | HM 1 | 1026 | 760 | 22 | 63 | −30 | 130 |
| Example 23 | M 23 | HM 1 | 1018 | 750 | 18 | 56 | −25 | 126 |
| Example 24 | M 24 | HM 1 | 989 | 723 | 24 | 65 | −34 | 117 |
| Example 25 | M 25 | HM 1 | 1030 | 755 | 20 | 63 | −29 | 125 |
| Example 26 | M 26 | HM 1 | 1034 | 760 | 18 | 58 | −23 | 129 |
| Example 27 | M 27 | HM 1 | 1027 | 754 | 21 | 63 | −38 | 120 |
| Example 28 | M 28 | HM 1 | 1025 | 755 | 21 | 60 | −31 | 128 |
| Example 29 | M 29 | HM 1 | 1030 | 760 | 22 | 61 | −37 | 109 |
| Example 30 | M 30 | HM 1 | 1025 | 749 | 18 | 57 | −34 | 127 |
| Example 31 | M 31 | HM 1 | 1025 | 758 | 22 | 63 | −30 | 161 |
| Example 32 | M 32 | HM 1 | 1037 | 764 | 20 | 61 | −24 | 155 |
| Example 33 | M 33 | HM 1 | 1030 | 760 | 21 | 60 | −29 | 149 |
| Example 34 | M 34 | HM 1 | 1033 | 763 | 22 | 64 | −25 | 154 |
| Example 35 | M 35 | HM 1 | 1025 | 759 | 21 | 64 | −31 | 140 |
| Example 36 | M 36 | HM 1 | 1039 | 766 | 21 | 62 | −23 | 157 |
| Example 37 | M 37 | HM 1 | 1026 | 755 | 23 | 65 | −28 | 138 |
| Example 38 | M 38 | HM 1 | 1035 | 764 | 21 | 63 | −24 | 156 |
| Example 39 | M 39 | HM 1 | 1024 | 756 | 24 | 65 | −29 | 135 |
| Example 40 | M 40 | HM 1 | 1034 | 768 | 20 | 61 | −24 | 162 |
| Example 41 | M 41 | HM 1 | 1059 | 794 | 21 | 63 | −29 | 184 |
| Example 42 | M 42 | HM 1 | 1051 | 790 | 21 | 64 | −24 | 180 |
| Example 43 | M 43 | HM 1 | 1042 | 781 | 20 | 63 | −27 | 179 |
| Example 44 | M 44 | HM 1 | 1080 | 809 | 20 | 60 | −24 | 182 |

For comparison, the same material tests were conducted with respect to conventional steels which were actually used for turbine rotors. As the conventional steels, there were prepared three kinds of samples, typified by conditions of chemical compositions (sample materials No. S1 to S3) shown in Table 4, i.e., CrMoV steel (ASTM-A470) for high temperature turbine rotor material ("conventional example 1", hereafter), NiCrMoV steel (ASTM-A471) for low temperature turbine rotor material ("conventional example 2", hereafter), and 12Cr steel (Japanese Patent Application Publication No.60-54385) for high temperature turbine rotor material ("conventional example 3", hereafter).

TABLE 4

| | Sample No. | Chemical Composition (wt %): C | Si | Mn | Cr | Mo | V | Ni | Nb | N | B | W | Fe | Remarks |
|---|---|---|---|---|---|---|---|---|---|---|---|---|---|---|
| Conventional Example 1 | S 1 | 0.29 | 0.07 | 0.77 | 1.10 | 1.15 | 0.22 | 0.34 | — | — | — | — | Bal. | CrMoV steel |
| Conventional Example 2 | S 2 | 0.24 | 0.08 | 0.23 | 1.84 | 0.39 | 0.12 | 3.56 | — | — | — | — | Bal. | NiCrMoV steel |
| Conventional Example 3 | S 3 | 0.14 | 0.03 | 0.59 | 10.03 | 0.99 | 0.18 | 0.68 | 0.05 | 0.048 | — | 1.02 | Bal. | 12Cr steel |
| Comparative Example 1 | S 4 | 0.04 | 0.08 | 0.18 | 10.83 | 1.39 | 0.20 | 2.46 | 0.10 | 0.025 | 0.007 | — | Bal. | — |
| Comparative Example 2 | S 5 | 0.33 | 0.12 | 0.15 | 11.38 | 1.65 | 0.21 | 2.81 | 0.08 | 0.030 | 0.008 | — | Bal. | — |
| Comparative Example 3 | S 6 | 0.12 | 0.09 | 0.13 | 7.57 | 1.66 | 0.19 | 2.48 | 0.07 | 0.029 | 0.009 | — | Bal. | — |
| Comparative Example 4 | S 7 | 0.14 | 0.08 | 0.22 | 13.48 | 1.72 | 0.25 | 2.50 | 0.07 | 0.023 | 0.006 | — | Bal. | — |

TABLE 4-continued

| | Sample No. | Chemical Composition (wt %) C | Si | Mn | Cr | Mo | V | Ni | Nb | N | B | W | Fe | Remarks |
|---|---|---|---|---|---|---|---|---|---|---|---|---|---|---|
| Comparative Example 5 | S 8 | 0.13 | 0.15 | 0.30 | 10.59 | 0.36 | 0.26 | 2.60 | 0.08 | 0.025 | 0.010 | — | Bal. | — |
| Comparative Example 6 | S 9 | 0.13 | 0.11 | 0.09 | 10.98 | 3.29 | 0.17 | 2.59 | 0.08 | 0.028 | 0.009 | — | Bal. | — |
| Comparative Example 7 | S 10 | 0.15 | 0.09 | 0.09 | 11.75 | 1.69 | 0.07 | 2.47 | 0.10 | 0.024 | 0.008 | — | Bal. | — |
| Comparative Example 8 | S 11 | 0.13 | 0.11 | 0.19 | 11.27 | 1.46 | 0.60 | 2.70 | 0.09 | 0.025 | 0.008 | — | Bal. | — |
| Comparative Example 9 | S 12 | 0.12 | 0.08 | 0.12 | 11.41 | 1.57 | 0.19 | 1.24 | 0.05 | 0.030 | 0.007 | — | Bal. | — |
| Comparative Example 10 | S 13 | 0.14 | 0.11 | 0.26 | 10.08 | 1.48 | 0.18 | 5.62 | 0.06 | 0.030 | 0.011 | — | Bal. | — |
| Comparative Example 11 | S 14 | 0.14 | 0.09 | 0.12 | 10.74 | 1.72 | 0.22 | 2.49 | 0.008 | 0.025 | 0.006 | — | Bal. | — |
| Comparative Example 12 | S 15 | 0.17 | 0.14 | 0.17 | 10.52 | 1.58 | 0.24 | 2.79 | 0.68 | 0.030 | 0.006 | — | Bal. | — |
| Comparative Example 13 | S 16 | 0.15 | 0.08 | 0.10 | 11.38 | 1.66 | 0.21 | 2.50 | 0.12 | 0.008 | 0.010 | — | Bal. | — |
| Comparative Example 14 | S 17 | 0.11 | 0.10 | 0.15 | 11.61 | 1.75 | 0.21 | 2.70 | 0.07 | 0.110 | 0.070 | — | Bal. | — |
| Comparative Example 15 | S 18 | 0.12 | 0.13 | 0.12 | 11.51 | 1.48 | 0.19 | 2.88 | 0.06 | 0.028 | 0.0007 | — | Bal. | — |
| Comparative Example 16 | S 19 | 0.12 | 0.13 | 0.10 | 10.69 | 1.43 | 0.24 | 2.22 | 0.08 | 0.024 | 0.024 | — | Bal. | — |
| Comparative Example 17 | S 20 | 0.14 | 0.08 | 0.17 | 10.88 | 1.06 | 0.19 | 2.56 | 0.10 | 0.030 | 0.009 | 0.019 | Bal. | — |
| Comparative Example 18 | S 21 | 0.14 | 0.08 | 0.14 | 11.45 | 0.70 | 0.22 | 2.63 | 0.07 | 0.029 | 0.008 | 5.53 | Bal. | — |
| Comparative Example 19 | S 22 | 0.13 | 0.08 | 0.23 | 10.78 | 0.06 | 0.21 | 2.66 | 0.06 | 0.028 | 0.006 | 1.25 | Bal. | — |
| Comparative Example 20 | S 23 | 0.14 | 0.09 | 0.15 | 11.70 | 5.71 | 0.26 | 2.31 | 0.08 | 0.025 | 0.007 | 2.04 | Bal. | — |

The three kinds of conventional steels shown in Table 4 were processed using the thermal conditions HS1 to HS3 shown in Table 2 to prepare samples, and the same material tests as those described above were conducted for the samples. The test results are shown in Table 5 below.

TABLE 5

| | Sample No. | Thermal Treatment No. | Tensile Test: Tensile Strength (Mpa) | 0.02% Yield Strength (Mpa) | Elongation (%) | Reduction of Area (%) | Impact Test FATT (° C.) | Creep Rupture Test: 580° C., 105 Hours Rupture Strength (Mpa) |
|---|---|---|---|---|---|---|---|---|
| Conventional Example 1 | S 1 | HS 1 | 835 | 602 | 19 | 56 | 104 | 90 |
| Conventional Example 2 | S 2 | HS 1 | 906 | 693 | 24 | 61 | −26 | 21 |
| Conventional Example 3 | S 3 | HS 1 | 938 | 716 | 22 | 58 | 58 | 177 |
| Comparative Example 1 | S 4 | HM 1 | 767 | 534 | 28 | 72 | −45 | 45 |
| Comparative Example 2 | S 5 | HM 1 | 1078 | 798 | 14 | 44 | −16 | 78 |
| Comparative Example 3 | S 6 | HM 1 | 976 | 688 | 20 | 60 | −30 | 84 |
| Comparative Example 4 | S 7 | HM 1 | 1019 | 713 | 22 | 64 | −3 | 82 |
| Comparative Example 5 | S 8 | HM 1 | 945 | 665 | 24 | 64 | −25 | 76 |
| Comparative Example 6 | S 9 | HM 1 | 1027 | 760 | 19 | 56 | 34 | 136 |
| Comparative Example 7 | S 10 | HM 1 | 968 | 671 | 23 | 65 | −27 | 80 |
| Comparative Example 8 | S 11 | HM 1 | 1039 | 775 | 21 | 61 | 23 | 103 |
| Comparative Example 9 | S 12 | HM 1 | 923 | 704 | 22 | 58 | 49 | 149 |
| Comparative Example 10 | S 13 | HM 1 | 1054 | 764 | 20 | 57 | −35 | 82 |
| Comparative Example 11 | S 14 | HM 1 | 1003 | 697 | 22 | 64 | −24 | 69 |
| Comparative Example 12 | S 15 | HM 1 | 1063 | 771 | 13 | 32 | 75 | 125 |
| Comparative Example 13 | S 16 | HM 1 | 759 | 515 | 26 | 73 | −50 | 67 |
| Comparative Example 14 | S 17 | HM 1 | 1046 | 748 | 12 | 39 | 86 | 86 |
| Comparative Example 15 | S 18 | HM 1 | 1025 | 760 | 21 | 60 | −36 | 80 |
| Comparative Example 16 | S 19 | HM 1 | 1036 | 763 | 20 | 57 | 74 | 141 |
| Comparative Example 17 | S 20 | HM 1 | 956 | 722 | 22 | 58 | −22 | 80 |
| Comparative Example 18 | S 21 | HM 1 | 1031 | 790 | 19 | 53 | 41 | 129 |
| Comparative Example 19 | S 22 | HM 1 | 951 | 731 | 22 | 60 | −19 | 78 |
| Comparative Example 20 | S 23 | HM 1 | 1027 | 784 | 20 | 57 | 54 | 132 |

Comparing to the characteristics of the three kinds of conventional steels, it was confirmed that the conventional example 1 was inferior in tensile strength and toughness, the conventional example 2 was most excellent in toughness, and the conventional example 3 was most excellent in tensile strength and creep rupture strength.

Characteristics of the steels of the present invention were compared to those of the conventional steels and analyzed. As a result, it was confirmed that any of examples 1 to 44 were superior to conventional examples 1 to 3 with respect to the values of tensile strength and 0.02% yield strength, and that the steels of the present invention were superior to the three kinds of conventional steels in tensile strength and creep rupture strength. Further, with respect to elongation and reduction of area, it was confirmed that examples 1 to 44 showed substantially the same values as those of the conventional examples 1 to 3, and had sufficient ductile properties.

With respect to FATT, any of the examples 1 to 44 showed the same or lower values as compared to conventional example 2 which was most excellent in toughness among all of the three conventional steels.

With respect to creep rupture strength, it was confirmed that any of examples 1 to 44 were superior to conventional example 1, and some of the examples showed substantially the same level as conventional example 3 which was most excellent in creep rupture strength among all of the three conventional steels, and that the steels of the present invention had extremely excellent creep rupture strength.

From the above, it was confirmed that the steels of the present invention were superior in tensile strength and toughness to the conventional steels used for steam turbine rotor, and had a creep rupture strength substantially equal to or close to that of the 12Cr steel which was most excellent among all of the three conventional steels, and that the steels of the present invention were high toughness heat-resistant steels of excellent tensile strength, toughness and creep rupture strength.

Comparative Examples 1 to 20

As comparative steels, comparative examples 1 to 20 were prepared using conditions (sample materials S4 to S23) of chemical compositions in which any one of the various elements shown in Table 4 exceeded upper or lower limits of the range of the present invention, and using the above-described thermal treatment condition HM1, and the same tests as described above were performed.

As a result, as shown in Table 5, it was confirmed that the comparative steels were inferior to the steels of the prevent invention in all of the characteristics of tensile strength, toughness and creep rupture strength, and that the comparative examples 1 to 5, 7, 10, 11, 13 to 15, 17 and 19 were inferior in creep rupture strength, the comparative examples 6, 8, 9, 12, 14, 16, 18 and 20 were inferior in toughness, and the comparative examples 1 and 13 were inferior in tensile strength.

It was also confirmed that another comparative example including Co showed the same results, i.e., was also inferior in all of the characteristics of tensile strength, toughness and creep rupture strength.

Second Embodiment

In the second embodiment, the influence of a thermal treatment condition was specifically observed by experiments in regard to a method of producing turbine rotors and the like using a high toughness heat-resistant steel.

EXAMPLE 45

In the example 45, the same test as described above was carried out for the sample material M1 which did not include W or Co using the thermal treatment condition HM1. As a result, it was confirmed as shown in Table 6 that the sample material M1 was excellent in all of the characteristics of tensile strength, toughness and creep rupture strength.

Therefore, according to the example 45, it is possible to provide a high toughness heat-resistant steel having preferable characteristics as a blank for, e.g., high/low pressure combined type turbine rotors, more particularly, to provide a high toughness heat-resistant steel having excellent tensile strength and toughness for a low pressure portion, and excellent creep rupture strength for high a pressure portion.

TABLE 6

| | | | Tensile Test | | | | | Creep Rupture Test |
|---|---|---|---|---|---|---|---|---|
| | Sample No. | Thermal Treatment No. | Tensile Strength (Mpa) | 0.02% Yield Strength (Mpa) | Elongation (%) | Reduction of Area (%) | Impact Test FATT (° C.) | 580° C., 105 Hours Rupture Strength (Mpa) |
| Example 45 | M 1 | HM 1 | 1022 | 758 | 22 | 64 | −32 | 127 |
| Example 46 | M 1 | HM 2 | 1023 | 801 | 21 | 63 | −35 | 128 |
| Example 47 | M 1 | HM 3 | 1007 | 734 | 22 | 63 | −56 | 98 |
| Example 48 | M 1 | HM 4 | 1046 | 772 | 20 | 60 | 9 | 140 |
| Example 49 | M 1 | HM 5 | 1115 | 832 | 20 | 61 | −27 | 123 |
| Example 50 | M 1 | HM 6 | 984 | 720 | 21 | 64 | −34 | 132 |
| Example 51 | M 1 | HM 7 | 1114 | 835 | 20 | 60 | −50 | 89 |
| Example 52 | M 1 | HM 8 | 981 | 723 | 21 | 63 | −9 | 147 |
| Example 53 | M 1 | HM 9 | 1119 | 886 | 20 | 59 | −51 | 88 |
| Example 54 | M 1 | HM 10 | 979 | 756 | 22 | 62 | −6 | 148 |
| Example 55 | M 1 | HS 4 | 773 | 525 | 26 | 73 | 10 | 67 |
| Example 56 | M 1 | HS 5 | 1037 | 771 | 13 | 36 | 24 | 134 |
| Example 57 | M 1 | HS 6 | 1298 | 896 | 12 | 34 | 68 | 131 |
| Example 58 | M 1 | HS 7 | 883 | 621 | 25 | 70 | −28 | 78 |
| Example 59 | M 31 | HM 1 | 1025 | 758 | 22 | 63 | −30 | 161 |
| Example 60 | M 31 | HM 2 | 1024 | 803 | 21 | 63 | −29 | 159 |
| Example 61 | M 31 | HM 3 | 1010 | 732 | 22 | 61 | −54 | 128 |
| Example 62 | M 31 | HM 4 | 1051 | 750 | 20 | 61 | 3 | 178 |
| Example 63 | M 31 | HM 5 | 1120 | 835 | 19 | 58 | −25 | 156 |
| Example 64 | M 31 | HM 6 | 991 | 721 | 20 | 62 | −33 | 164 |
| Example 65 | M 31 | HM 7 | 1126 | 842 | 21 | 64 | −49 | 190 |
| Example 66 | M 31 | HM 8 | 982 | 719 | 20 | 60 | −5 | 91 |
| Example 67 | M 31 | HM 9 | 1130 | 892 | 22 | 63 | −52 | 189 |
| Example 68 | M 31 | HM 10 | 986 | 745 | 19 | 58 | −10 | 87 |
| Example 69 | M 31 | HS 4 | 756 | 507 | 28 | 78 | 15 | 59 |
| Example 70 | M 31 | HS 5 | 1030 | 811 | 12 | 37 | 33 | 162 |
| Example 71 | M 31 | HS 6 | 1316 | 907 | 12 | 31 | 83 | 166 |
| Example 72 | M 31 | HS 7 | 859 | 606 | 22 | 67 | −26 | 75 |
| Example 73 | M 41 | HM 1 | 1059 | 794 | 21 | 63 | −29 | 184 |
| Example 74 | M 41 | HM 2 | 1054 | 860 | 20 | 64 | −27 | 181 |
| Example 75 | M 41 | HM 3 | 1057 | 799 | 21 | 61 | −52 | 146 |
| Example 76 | M 41 | HM 4 | 1064 | 803 | 21 | 59 | 11 | 197 |
| Example 77 | M 41 | HM 5 | 1136 | 859 | 20 | 58 | −24 | 176 |
| Example 78 | M 41 | HM 6 | 1003 | 736 | 22 | 62 | −33 | 188 |

TABLE 6-continued

| | Sample No. | Thermal Treatment No. | Tensile Test: Tensile Strength (Mpa) | Tensile Test: 0.02% Yield Strength (Mpa) | Tensile Test: Elongation (%) | Tensile Test: Reduction of Area (%) | Impact Test FATT (° C.) | Creep Rupture Test 580° C., 105 Hours Rupture Strength (Mpa) |
|---|---|---|---|---|---|---|---|---|
| Example 79 | M 41 | HM 7 | 1138 | 857 | 21 | 60 | −49 | 137 |
| Example 80 | M 41 | HM 8 | 1006 | 736 | 20 | 59 | 5 | 211 |
| Example 81 | M 41 | HM 9 | 1140 | 940 | 20 | 60 | −50 | 132 |
| Example 82 | M 41 | HM 10 | 1001 | 762 | 21 | 58 | 10 | 208 |
| Example 83 | M 41 | HS 4 | 746 | 509 | 29 | 74 | 14 | 65 |
| Example 84 | M 41 | HS 5 | 1067 | 803 | 12 | 36 | 38 | 193 |
| Example 85 | M 41 | HS 6 | 1348 | 993 | 10 | 31 | 80 | 185 |
| Example 86 | M 41 | HS 7 | 894 | 637 | 23 | 66 | −31 | 82 |

EXAMPLE 46

In the example 46, thermal treatment condition HM2 was used that was different from HM1 only in that a second tempering step at 475° C. was added. As a result, it was confirmed as shown in Table 6 that 0.02% yield strength was significantly increased, and FATT and creep rupture strength varied were little, as compared to example 45 using HM1.

Therefore, according to the example 46, the tensile strength can further be enhanced by carrying out a second tempering, and if the example is used for producing, e.g., rotor blanks, such effects can more effectively be exhibited.

EXAMPLE 47

In example 47, the thermal treatment condition HM3 was used that was the same as the condition HM1 except that the hardening temperature was 1,000° C. As a result, it was confirmed as shown in Table 6 that although creep rupture strength tended to be lowered, tensile strength and 0.02% yield strength varied little, and FATT was substantially lowered, as compared to example 45 using HM1.

Therefore, according to the example 47, it is possible to obtain a high toughness heat-resistant steel having characteristics suitable for, e.g., a low pressure portion and the like of a high/low pressure combined type turbine rotor, i.e., superior toughness, by carrying out hardening at a low temperature in a range of 950° C. to 1,030° C.

EXAMPLE 48

In example 48, the thermal treatment condition HM4 was used that was the same as the condition HM1 except that the hardening temperature was 1,070° C. As a result, it was confirmed as shown in Table 6 that although FATT is increased, tensile strength and 0.02% yield strength varied little, and creep rupture strength was increased, as compared to example 45 using HM1.

Therefore, according to example 48, it is possible to obtain high toughness heat-resistant steel having characteristics suitable for, e.g., a high or intermediate pressure portion and the like of a high/low pressure combined type turbine rotor, i.e., superior creeping fracture strength, by carrying out hardening at a high heating temperature in a range of 1,030° C. to 1,120° C.

EXAMPLE 49

In example 49, the thermal treatment condition HM5 was used that was the same as the condition HM1 except that the tempering temperature was 600° C. As a result, it was confirmed as shown in Table 6 that creeping fracture strength was slightly lowered, FATT was slightly increased, and tensile strength and 0.02% yield strength were significantly increased, as compared to example 45 using HM1.

Therefore, according to example 49, it is possible to obtain a high toughness heat-resistant steel having characteristics suitable for, e.g., a low pressure portion and the like of a high/low pressure combined type turbine rotor, i.e., superior tensile strength, by carrying out tempering at a low temperature in a range of 550° C. to 630° C.

EXAMPLE 50

In example 50, the thermal treatment condition HM6 was used that was the same as the condition HM1 except that the tempering temperature was 680° C. As a result, it was confirmed as shown in Table 6 that 0.02% yield strength was lowered, FATT was slightly lowered, creep rupture strength was increased, as compared to example 45 using HM1.

Therefore, according to the example 50, it is possible to obtain a high toughness heat-resistant steel having characteristics suitable for, e.g., a high or intermediate pressure portion and the like of a high/low pressure combined type turbine rotor, i.e., superior creeping fracture strength, by carrying out tempering at a high temperature in a range of 630° C. to 740° C.

EXAMPLE 51

In example 51, the thermal treatment condition HM7 was used that was the same as the condition HM1 except that the hardening temperature was set at 1,000° C. and the tempering temperature was 600° C. As a result, it was confirmed as shown in Table 6 that although creep rupture strength was lowered, FATT was significantly lowered, and 0.02% yield strength was significantly increased, as compared to example 45 using HM1.

Therefore, according to example 51, it is possible to obtain a high toughness heat-resistant steel having characteristics suitable for, e.g., a low pressure portion and the like of a high/low pressure combined type turbine rotor, i.e., superior tensile strength and toughness, by carrying out hardening at a low temperature in a range of 950° C. to 1,030° C., and tempering at a low temperature in a range of 550° C. to 630° C.

EXAMPLE 52

In example 52, the thermal treatment condition HM8 was used that was the same as the condition HM1 except that the hardening temperature was 1,070° C. and the tempering temperature was 680° C. As a result, it was confirmed as shown in Table 6 that although tensile strength and 0.02% yield strength were lowered and FATT was increased, creep rupture strength was significantly increased, as compared to example 45 using HM1.

Therefore, according to example 52, it is possible to obtain a high toughness heat-resistant steel having characteristics suitable for, e.g., a low pressure portion and the like of a high/low pressure combined type turbine rotor, i.e., a further superior creeping fracture strength, by carrying out a hardening at a high temperature in a range of 1,030° C. to 1,120° C., and tempering at a high temperature in a range of 630° C. to 740° C.

EXAMPLE 53

In example 53, the thermal treatment condition HM9 was used that was the same as the condition HM7 except that a step for conducting a second tempering at 475° C. was added. As a result, it was confirmed as shown in Table 6 that 0.02% yield strength was significantly increased, and FATT and creep rupture strength varied little, as compared to example 51 using HM7.

Therefore, according to example 53, it is possible to obtain a high toughness heat-resistant steel having characteristics suitable for, e.g., a low pressure portion and the like of a high/low pressure combined type turbine rotor, i.e., a further superior tensile strength and toughness, by carried out a hardening at a low temperature in a range of 950° C. to 1,030° C., tempering at a low temperature in a range of 550° C. to 630° C., and a second tempering.

EXAMPLE 54

In example 54, the thermal treatment condition HM10 was used that was the same as the condition HM8 except that a step for conducting a second tempering at 475° C. was added. As a result, it was confirmed as shown in Table 6 that 0.02% yield strength was increased, and FATT and creep rupture strength varied little, as compared to example 52 using HM8.

Therefore, according to example 54, if hardening is carried out at a high temperature in a range of 1,030° C. to 1,120° C. and tempering is carried out at a low temperature in a range of 630° C. to 740° C., it is possible to obtain a high toughness heat-resistant steel maintaining characteristics suitable for, e.g., a high pressure portion of a high/low pressure combined type turbine rotor, i.e., a further superior creep rupture strength, even if a second tempering is carried out.

EXAMPLE 55

In example 55, the thermal treatment condition HS4 was used that was the same as the condition HM1 except that the hardening temperature was 930° C. As a result, it was confirmed as shown in Table 6 that all of the tensile strength, toughness and creep rupture strength were low, as compared to example 45 using HM1.

EXAMPLE 56

In example 56, the thermal treatment condition HS5 was used that was the same as the condition HM1 except that the hardening temperature was set at 1,140° C. As a result, it was confirmed as shown in Table 6 that especially toughness and ductile properties were low, as compared to example 45 using HM1.

EXAMPLE 57

In example 57, the thermal treatment condition HS6 was used that was the same as the condition HM1 except that the tempering temperature was 530° C. As a result, it was confirmed as shown in Table 6 that especially toughness and ductile properties were low, as compared to example 45 using HM1.

EXAMPLE 58

In example 58, the thermal treatment condition HS7 was used that was the same as the condition HM1 except that the tempering temperature was 760° C. As a result, it was confirmed as shown in Table 6 that especially tensile strength and creep rupture strength were low, as compared to example 45 using HM1.

EXAMPLES 59 to 72

In examples 59 to 72, the conditions HM1 to HM10 and HS4 to HS7 having different thermal conditions as described above were respectively applied to sample materials M31 including W. As a result, substantially the same results as those of the sample materials M1 were obtained as shown in Table 6.

EXAMPLES 73 to 86

In examples 73 to 86, the conditions HM1 to HM10 and HS4 to HS7 having different thermal conditions as described above were respectively applied to sample materials M41 including W and Co. As a result, substantially the same results as those of the sample materials M1 were obtained as shown in Table 6.

Third Embodiment

This embodiment was carried out by changing the method of producing a steel ingot which constitutes a turbine rotor blank.

EXAMPLE 87

In example 87, sample material E1 according to the present invention as shown in Table 7 was used. The sample material was melted in an electrical furnace and then, was cast in electrode mole of electroslag remelting to produce a steel ingot. The steel ingot was used as consumable electrode to produce a steel ingot using electroslag remelting. The resultant steel ingot was heated to 1,200° C. and press-forged to provide a model (1,000 mmϕ×800 mm) of a portion corresponding to a rotor. The model was subjected to thermal treatments, i.e., hardening at 1,030° C. and then, tempering at a heating temperature of 630° C.

TABLE 7

| | Sample No. | Chemical Composition (wt %) | | | | | | | | | | | | |
|---|---|---|---|---|---|---|---|---|---|---|---|---|---|---|
| | | C | Si | Mn | Cr | Mo | V | Ni | Nb | N | B | W | Co | Fe |
| Example 87 | E 1 | 0.13 | 0.06 | 0.09 | 11.63 | 1.65 | 0.20 | 2.70 | 0.05 | 0.024 | 0.007 | — | — | Bal. |
| Example 88 | E 2 | 0.14 | 0.09 | 0.11 | 11.49 | 0.69 | 0.19 | 2.53 | 0.07 | 0.021 | 0.008 | 1.86 | 3.01 | Bal. |
| Example 89 | V 1 | 0.13 | 0.07 | 0.08 | 11.70 | 1.63 | 0.21 | 2.68 | 0.06 | 0.023 | 0.008 | — | — | Bal. |
| Example 90 | V 2 | 0.14 | 0.08 | 0.13 | 11.51 | 0.72 | 0.20 | 2.52 | 0.07 | 0.021 | 0.008 | 1.83 | 2.99 | Bal. |

Test pieces were cut out from a surface layer portion and center portion of the sample material obtained in the above described manner, and tensile test, Charpy impact test and creep fracture test were carried out with respect the test pieces at room temperature, thereby providing tensile strength, 0.02% yield strength, elongation, reduction of area, FATT and fracture strength for 105 hours at 580° C.

As a result, it was confirmed that the surface layer portion and the center portion showed substantially the same values of tensile strength, 0.02% yield strength, elongation, reduction of area, FATT and creep rupture strength, as shown in Table 8.

EXAMPLE 89

In example 89, sample material V1 which was substantially same as the sample material E1 used in the example 87 as shown in Table 7 was used. The sample material was melted in an electrical furnace and then, was formed into a steel ingot using vacuum carbon deoxidization, and was heated to 1,200° C. and press-forged to provide a model (1,000 mm(×800 mm) of a portion corresponding to a rotor. The model was subjected to the same thermal treatments as those described above, and the same tests as those described above were carried out on the resultant sample material.

As a result, as shown in Table 8, it was confirmed that although the surface layer portion and the center portion

TABLE 8

| | Producing Condition | Thermal Treatment Condition | Portion of Test Piece | Tensile Test: Tensile Strength (Mpa) | Tensile Test: 0.02% Yield Strength (Mpa) | Tensile Test: Elongation (%) | Tensile Test: Reduction of Area (%) | Impact Test FATT (° C.) | Creep Rupture Test 580° C., $10^5$ Hours Rupture Strength (Mpa) |
|---|---|---|---|---|---|---|---|---|---|
| Example 87 | Electoroslag Remelting | Harding: 1030° C. × 20 h → Oil-cooling | Surface Layer Portion | 1029 | 752 | 22 | 65 | −34 | 129 |
| | | Tempering: 630° C. × 30 h → Air-cooling | Center Portion | 1035 | 761 | 21 | 64 | −37 | 126 |
| Example 88 | Electoroslag Remelting | Harding: 1030° C. × 20 h → Oil-cooling | Surface Layer Portion | 1054 | 789 | 20 | 62 | −30 | 182 |
| | | Tempering: 630° C. × 30 h → Air-cooling | Center Portion | 1061 | 796 | 21 | 60 | −37 | 176 |
| Example 89 | Vacuum Carbon Deoxidization | Harding: 1030° C. × 20 h → Oil-cooling | Surface Layer Portion | 1027 | 750 | 23 | 63 | −31 | 127 |
| | | Tempering: 630° C. × 30 h → Air-cooling | Center Portion | 1032 | 758 | 20 | 59 | −27 | 123 |
| Example 90 | Vacuum Carbon Deoxidization | Harding: 1030° C. × 20 h → Oil-cooling | Surface Layer Portion | 1058 | 790 | 22 | 62 | −29 | 179 |
| | | Tempering: 630° C. × 30 h → Air-cooling | Center Portion | 1064 | 795 | 17 | 53 | −18 | 170 |

Therefore, according this example, a more uniform rotor blank having little difference in tensile strength, ductile properties, toughness and creep rupture strength between the surface layer portion and the center portion, is obtained by producing a steel ingot using electroslag remelting for forming a turbine rotor blank made of high toughness heat-resistant steel.

EXAMPLE 88

In example 88, sample material E2 including W and Co within a range of the present invention shown in Table 7 was used. According to this example 88, it was confirmed that the same results as those described above are obtained, and especially its effect was remarkably present a large amount of alloy element was added.

showed substantially the same values of tensile strength, 0.02% yield strength, and creep rupture strength, the center portion had lower elongation and reduction of area, and FATT had an upward tendency at the center portion.

EXAMPLE 90

In example 90, sample material V2which was substantially the same as the sample material E2 used in example 88 as shown in Table 7 was prepared except that the was treated in example 89. According to example 90, it was confirmed that the same results as those described above are obtained, and especially its effect was remarkably present a large amount of alloy element was added.

Various modifications and alterations to the above-described preferred embodiment will be apparent to those skilled in the art. Accordingly, this description of the invention should be considered exemplary and not as limiting the scope and sprit of the invention as set forth in the following claims.

What is claimed is:

1. A high toughness heat-resistant steel having a chemical composition comprising: 0.05 to 0.30 wt % C, 0.20 wt % or less Si, 1.0 wt % or less Mn, 8.0 to 14.0 wt % Cr, 0.5 to 3.0 wt % Mo, 0.10 to 0.50 wt % V, greater than 2.0 to 5.0 wt % Ni, 0.01 to 0.50 wt % Nb, 0.01 to 0.08 wt % N, 0.001 to 0.020 wt % B, and the balance being Fe and unavoidable impurities.

2. The high toughness heat-resistant steel according to claim 1, wherein said chemical composition further comprises 0.5 to 6.0 wt % Co.

3. A high toughness heat-resistant steel having a chemical composition comprising: 0.05 to 0.30 wt % C, 0.20 wt % or less Si, 1.0 wt % or less Mn, 8.0 to 14.0 wt % Cr, 0.1 to 2.0 wt % Mo, 0.3 to 5.0 wt % W, 0.10 to 0.50 wt % V, greater than 2.0 to 5.0 wt % Ni, 0.01 to 0.50 wt % Nb, 0.01 to 0.08 wt % N, 0.001 to 0.020 wt % B, and the balance being Fe and unavoidable impurities.

4. The high toughness heat-resistant steel according to claim 3, wherein said chemical composition further comprises 0.5 to 6.0 wt % Co.

5. A turbine rotor formed of a high toughness heat-resistant steel having a chemical composition comprising: 0.05 to 0.30 wt % C, 0.20 wt % or less Si, 1.0 wt % or less Mn, 8.0 to 14.0 wt % Cr, 0.5 to 3.0 wt % Mo, 0.10 to 0.50 wt % V, greater than 2.0 to 5.0 wt % Ni, 0.01 to 0.50 wt % Nb, 0.01 to 0.08 wt % N, 0.001 to 0.020 wt % B, balance Fe, and unavoidable impurities.

6. The turbine rotor according to claim 5, wherein said chemical composition the composition further comprises 0.5 to 6.0 wt % Co.

7. A turbine rotor formed of a high toughness heat-resistant steel having a chemical composition comprising: 0.05 to 0.30 wt % C, 0.20 wt % or less Si, 1.0 wt % or less Mn, 8.0 to 14.0 wt % Cr, 0.1 to 2.0 wt % Mo, 0.3 to 5.0 wt % W, 0.10 to 0.50 wt % V, greater than 2.0 to 5.0 wt % Ni, 0.01 to 0.50 wt % Nb, 0.01 to 0.08 wt % N, 0.001 to 0.020 wt % B, and the balance being Fe and unavoidable impurities.

8. The turbine rotor according to claim 7, wherein said chemical composition further comprises 0.5 to 6.0 wt % Co.

9. A method of producing a turbine rotor, comprising the steps of:

preparing a steel material having a chemical composition comprising: 0.05 to 0.30 wt % C, 0 to 0.20 wt % Si, 0 to 1.0 wt % Mn, 8.0 to 14.0 wt % Cr, 0.5 to 3.0 wt % Mo, 0.10 to 0.50 wt % V, greater than 2.0 to 5.0 wt % Ni, 0.01 to 0.50 wt % Nb, 0.01 to 0.08 wt % N, 0.001 to 0.020 wt % B, balance Fe and unavoidable impurities;

forming the steel material into a blank body of the turbine rotor;

performing a hardening on the blank body; and subsequently performing at least one tempering on the hardened blank body, thereby the tempered blank body providing the turbine rotor having high toughness.

10. The method of turbine rotor according to claim 9, wherein said chemical composition further comprises 0.5 to 6.0 wt % Co.

11. The method of turbine rotor according to claim 9, wherein said hardening is performed at a temperature in the range of 950° C. to 1,120° C., said tempering being performed at a temperature in the range of 550° C. to 740° C.

12. The method of producing a turbine rotor according to claims 11, said turbine rotor comprises a high pressure portion, an intermediate pressure portion, and a low pressure portion, said hardening being performed at temperature in the range of 1,030° C. to 1,120° C. for the high or intermediate pressure portion and 950° C. to 1,030° C. for the low pressure portion.

13. The method of producing a turbine rotor according to claim 12, the tempering is performed at a temperature in the range of 550° C. to 630° C. for the high or the intermediate pressure portion and 630° C. to 740° C. for the low pressure portion.

14. The method of producing a turbine rotor according to claim 9, wherein the steel material is a steel ingot formed by using electroslag remelting.

15. A method of producing a turbine rotor, comprising the steps of:

preparing a steel material having a chemical composition comprising: 0.05 to 0.30 wt % C, 0.20 wt % or less Si, 1.0 wt % or less Mn, 8.0 to 14.0 wt % Cr, 0.1 to 2.0 wt % Mo, 0.3 to 5.0 wt % W, 0.10 to 0.50 wt % V, greater than 2.0 to 5.0 wt % Ni, 0.01 to 0.50 wt % Nb, 0.01 to 0.08 wt % N, 0.001 to 0.020 wt % B, and the balance being Fe and unavoidable impurities;

forming the steel material into a blank body of the turbine rotor;

performing a hardening on the blank body; and subsequently performing at least one tempering on the hardened blank body, thereby the tempered blank body providing the turbine rotor having high toughness.

16. The method of turbine rotor according to claim 15, wherein said chemical composition further comprises 0.5 to 60 wt % Co.

17. The method of turbine rotor according to claim 15, wherein said hardening is performed at a temperature in the range of 950° C. to 1,120° C., said tempering being performed at a temperature in the range of 550° C. to 740° C.

18. The method of producing a turbine rotor according to claims 17, said turbine rotor comprises a high pressure portion, an intermediate pressure portion, and a low pressure portion, said hardening being performed at temperature in the range of 1,030° C. to 1,120° C. for the high or intermediate pressure portion and 950° C. to 1,030° C. for the low pressure portion.

19. The method of producing a turbine rotor according to claim 18, the tempering is performed at a temperature in the range of 550° C. to 630° C. for the high or the intermediate pressure portion and 630° C. to 740° C. for the low pressure portion.

20. The method of producing a turbine rotor according to claim 15, wherein the steel material is a steel ingot formed by using electroslag remelting.

* * * * *